US007681381B2

(12) United States Patent
Pathak

(10) Patent No.: US 7,681,381 B2
(45) Date of Patent: Mar. 23, 2010

(54) APPARATUS AND METHOD FOR LOADING AN END-LOADABLE CARTON

(75) Inventor: Peter Pathak, Atlanta, GA (US)

(73) Assignee: MeadWestvaco Packaging Systems LLC, Richmond, VA (US)

( * ) Notice: Subject to any disclaimer, the term of this patent is extended or adjusted under 35 U.S.C. 154(b) by 0 days.

(21) Appl. No.: 11/960,138

(22) Filed: Dec. 19, 2007

(65) Prior Publication Data

US 2008/0142577 A1 Jun. 19, 2008

Related U.S. Application Data

(63) Continuation-in-part of application No. 11/868,253, filed on Oct. 5, 2007.

(60) Provisional application No. 60/870,830, filed on Dec. 19, 2006.

(51) Int. Cl.
*B65B 43/39* (2006.01)

(52) U.S. Cl. ..... 53/566; 53/458; 53/468; 53/376.7; 53/382.1

(58) Field of Classification Search ..... 53/458, 53/566, 468, 376.3, 376.7, 377.2, 382.1, 53/382.2, 382.3, 387.1, 387.2; 229/101; 206/156, 175, 427, 434

See application file for complete search history.

(56) References Cited

U.S. PATENT DOCUMENTS

| | | | | |
|---|---|---|---|---|
| 2,249,881 | A * | 7/1941 | Bouchelle | 206/736 |
| 3,817,444 | A * | 6/1974 | Yoch | 229/101 |
| 4,070,789 | A * | 1/1978 | Levenson | 446/478 |
| 4,589,246 | A * | 5/1986 | Wood | 53/491 |
| 4,894,104 | A * | 1/1990 | Hemus | 53/491 |
| 5,020,337 | A * | 6/1991 | Krieg | 62/464 |
| 2007/0051781 | A1 * | 3/2007 | Holley | 229/101 |
| 2008/0120948 | A1 * | 5/2008 | Martin et al. | 53/491 |

* cited by examiner

*Primary Examiner*—Hemant M Desai
(74) *Attorney, Agent, or Firm*—Karen L. Ware; Tsugihiko Suzuki

(57) ABSTRACT

A substantially tubular end-loadable carton (200) comprising a top wall (212), an inwardly-extending structure (X2) foldably adjoining said top wall (212) stowable in a substantially flat-face position with an underside of said top wall (212), and a top end flap (X1) connected to said inwardly-extending structure is translated in a direction (F) and a flap deflector (310) is disposed to engage and deflect the end flap (X1*a*) downwardly and thereby cause the inwardly-extending structure (X2*a*) to pivot upwardly inside the carton (200) into substantially flat-face position with the underside of the top wall (212) of the carton (200).

11 Claims, 7 Drawing Sheets

APPARATUS AND METHOD FOR LOADING AN END-LOADABLE CARTON

RELATED APPLICATIONS

This application claims priority to U.S. Provisional Application No. 60/870,830, filed Dec. 19, 2006; and is a continuation-in-part of U.S. application Ser. No. 11/868,253, filed Oct. 5, 2007, which are hereby incorporated by reference in their entirety.

TECHNICAL FIELD

This invention relates generally to machines and systems for loading cartons. More specifically, the invention relates to apparatuses and methods for preparing end-loadable cartons for loading.

BACKGROUND OF THE INVENTION

Certain cartons include flaps or other elements that are stowed beneath the top wall of the carton. For instance, some cartons are expandable or can otherwise be arranged to include an expanded open-top portion, which is sometimes referred to as a chimney. The expanded portion of the carton increases the volume or capacity of the carton and allows a consumer to, for example, pour ice into the expanded portion and on top of the contents of the carton. Thus, these cartons are sometimes referred to as ice-pack cartons. It is also desirable for such cartons to retain liquid that may accumulate in the bottom of the carton. In certain ice-pack carton configurations, extension panels and gusset panels, or other panels, are elements that are stowed beneath the top wall of the carton and form at least a portion of an expandable structure that allows for the expansion of the carton.

Stowed elements of an ice-pack type carton in particular can undesirably inhibit machine loading of articles into the carton. This is because the placement of the extension panels and gusset panels beneath the top wall of the carton can at least partially obstruct sliding movement of articles that are introduced into the carton via an open end thereof when the carton is arranged as a tubular structure for loading. The stowed elements prevent smooth mechanical loading and may cause the articles to tip. One method of preventing the articles from tipping is to hand load the cartons. However, hand-loading is an inefficient method of loading large quantities of cartons.

Another approach to prevent the articles from tipping or being obstructed as they are loaded is to arrange the extension panels and gusset panels such that they are secured to and stowed against the outside of the top wall or end walls, so that the interior of the carton is free from obstructions. However, stowing the extension and gusset panels against the outside of the carton is a less aesthetically appealing design since the walls of the carton are then not clean or continuous.

Thus, a heretofore unaddressed need exists in the industry to provide an apparatus and method for loading cartons having an inwardly-extending feature such as a chimney-forming expansion element that is stowed inside the carton.

SUMMARY OF THE INVENTION

The shortcomings of the prior art are overcome by a system, method and apparatus for loading a carton having an inwardly-extending element that is stowed underneath a top wall of the carton such that loading of the carton is not hindered.

The present invention provides a method of preparing a carton for loading and further provides an apparatus for facilitating the method.

The invention provides a carton formable from a blank into a tubular structure, which structure has elements that are stowed beneath the top wall of the carton when the carton is loaded with articles such as cans. The elements that extend inwardly into the tubular structure/carton and that are stowed beneath the top wall thereof hingedly adjoin the top wall and adjoin respective end flaps. In an aspect of the invention, the stowable elements and the respective end flaps adjoined thereto are foldable with respect to one another.

The method taught by the invention comprises engaging the end flaps such that the respective adjoining elements are pivoted upwardly into face-contacting position with the underside of the top wall.

The apparatus taught by the invention engages the end flaps of cartons as those tubular structures are moved along a path so as to cause the respective adjoining, inwardly-extending elements to pivot upwardly. In one aspect, the apparatus comprises a guide that downwardly deflects an end flap thereby causing the respective adjoining, inwardly-extending element to pivot upwardly. In another aspect, the apparatus further provides a means for both deforming and deflecting an end flap so as to inhibit undesired folding of an end flap and element with respect to one another and thereby promote pivoting.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
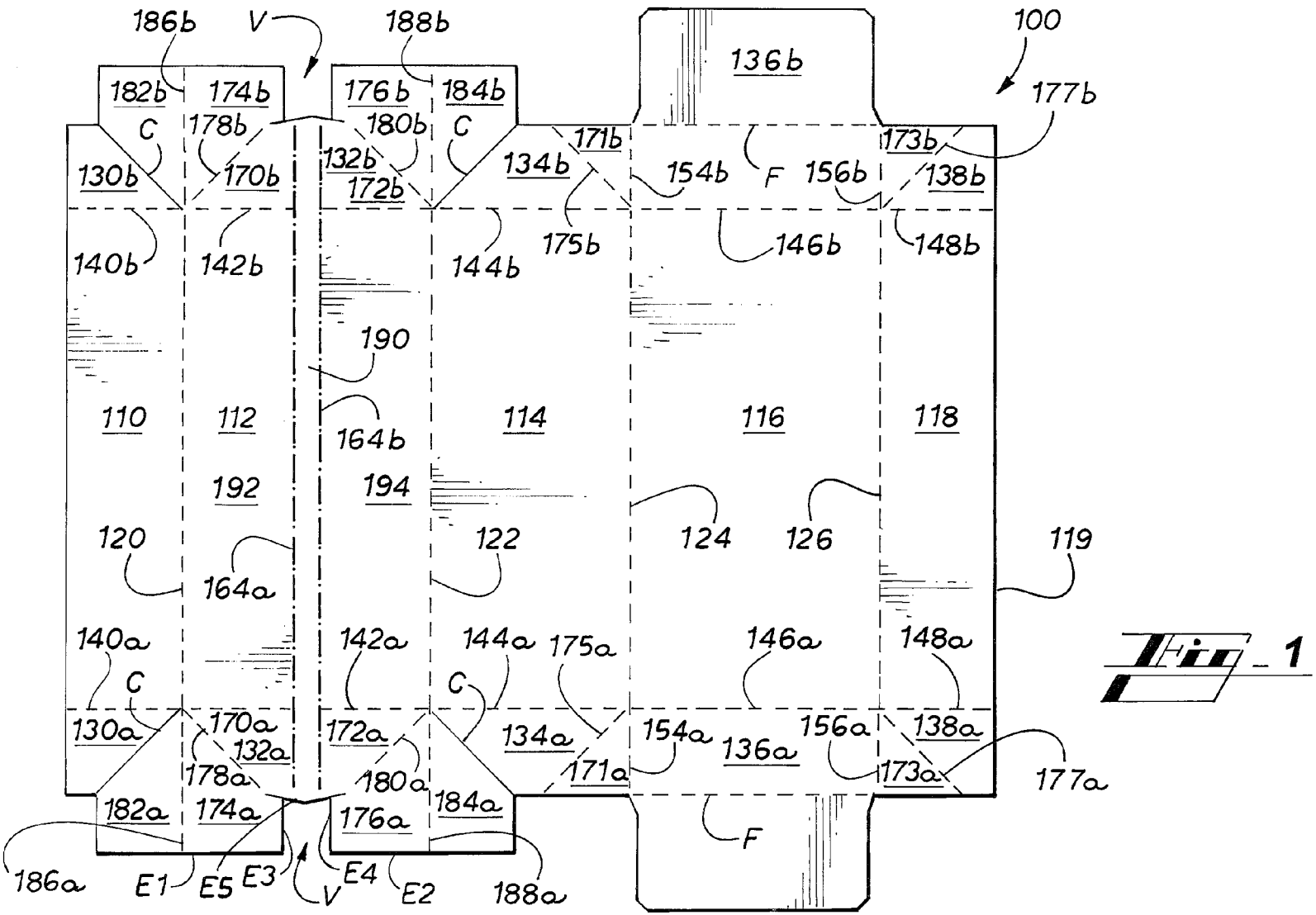
FIG. 1 is an exemplary embodiment of a blank for forming an exemplary expandable carton.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of an apparatus and method for folding and loading a carton that includes an inwardly-extending structure. Specifically, the apparatus and method are focused towards folding expansion feature elements that are stowed inside the cartons such that the expansion elements do not impede end loading of the carton.

The apparatus and methods described herein are described with respect to an exemplary embodiment ice-pack carton 200 that is formed from a blank 100. The carton 200 and blank 100 forming the carton are also described in co-pending U.S. application Ser. No. 11/868,253, filed Oct. 5, 2007, which application is hereby incorporated by reference in its entirety. The apparatus and the methods of the invention are not only applicable to the exemplary embodiment of the carton shown, but are also applicable to alternative types of cartons having inwardly-extending features that are stowed against the interior surface of a carton wall.

Referring to FIG. 1, the blank 100 is preferably a single sheet of suitable substrate. It is to be understood that, as used herein the term "suitable substrate" includes all manner of foldable sheet material such as paperboard, corrugated board, cardboard, plastic, and the like. The carton may include a water-resilient coating on at least one surface and may be equipped with features that prevent liquid from leaking from the bottom of the carton. In the exemplary embodiment, the blank is designed for packaging beverage cans. It is envisaged that other articles and/or different arrangements of articles may be contained within the carton and that the blank may therefore be sized accordingly.

As used herein, the terms "fold line" and "severance line" refer to all manner of means for indicating optimal fold or cut locations, respectively, including frangible or otherwise weakened lines, perforations, a line of perforations, a line of short slits, a line of half-cuts, a single half-cut, a cut line, scored lines, slits, printed lines, any combination thereof, and the like. To aid in distinguishing the features of the blank 100 and tubular structure T, fold lines are shown as dashed lines in FIG. 1-9.

Figure 9:
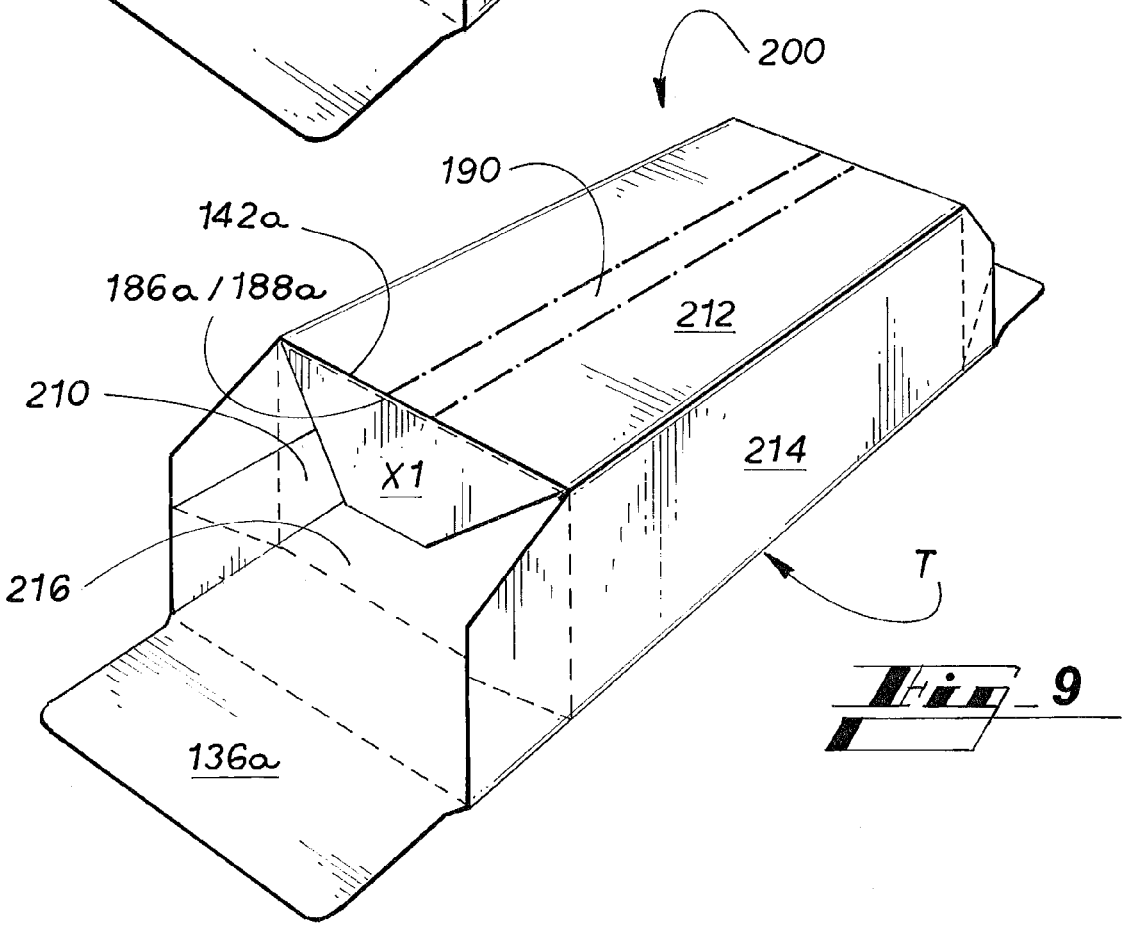
Figure 10:
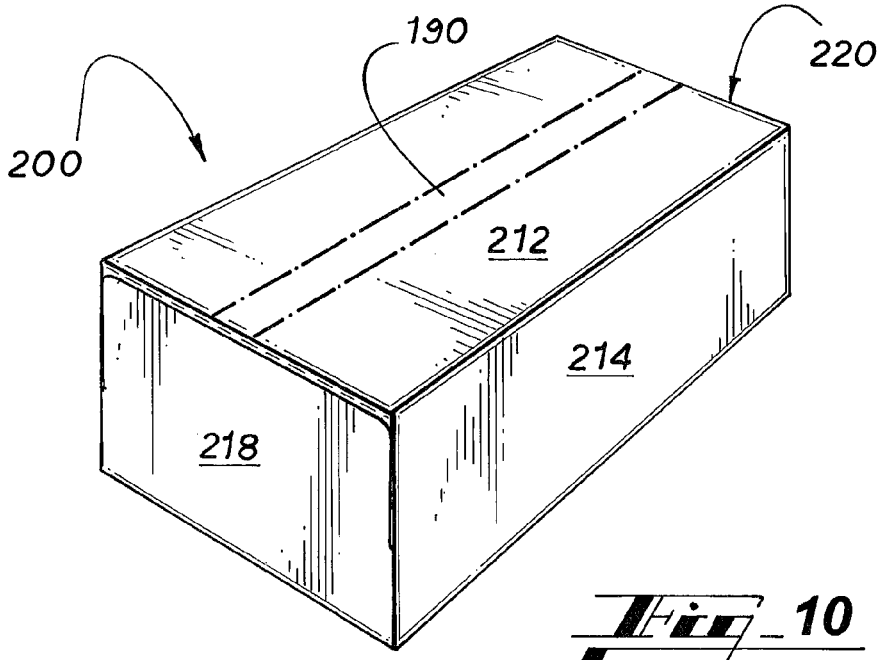
FIG. 10 is a perspective view of the carton formed from the blank of FIG. 1.

The blank 100 includes a series of primary panels which define the walls of a tubular structure T (shown in FIGS. 8 and 9) that defines the body of the expandable carton 200 that is shown in FIG. 10. The blank 100 includes first side panels 110, 118 that are partial side panels, a top panel 112, a second side panel 114 that is a full side panel, and a bottom panel 116. The primary panels are hingedly connected one to the next along fold lines. First side panel 110 is hingedly connected to the top panel 112 along fold line 120, the top panel 112 is hingedly connected to the second side panel 114 along fold line 122, the second side panel 114 is hingedly connected to the bottom panel 116 along fold line 124, and the bottom panel 116 is hingedly connected to first side panel 118 along fold line 126.

End flaps are hingedly connected to opposite ends of each primary panel along fold lines. Certain of the end flaps form end closure structures at respective open ends of the tubular structure T and thereby define the end walls of the expandable carton 200. The blank 100 is substantially symmetric such that the end flaps that are hingedly connected to opposite ends of each primary panel are substantially identical. Accordingly, the end closure structures of the carton 200 are substantially identical and like references have been used with a suffix "a" or "b" affixed to distinguish one end of the carton from the other. Thus, the description of an element or group of elements having a suffix "a" is generally applicable to a like-numbered element or group of elements having a suffix "b." In several instances herein, for clarity, only one of the like elements may be described unless a description of the other or both of the like elements is useful for understanding the invention.

First side end flaps 130*a*, 138*a* are hingedly connected to first side panels 110, 118 along fold lines 140*a*, 148*a*, respectively. A top end flap 132*a* is hingedly connected to top panel 112 along fold line 142*a*. A second side end flap 134*a* is hingedly connected to second side panel 114 along fold line 144*a*. Lastly, a bottom end flap 136*a* is hingedly connected to bottom panel 116 along fold line 146*a*. The bottom end flap 136*a* is preferably long enough to cover an entire open end of the tubular structure T and can include a fold line F to facilitate folding and loading the carton 200. The top end flap 132*a* includes first extension panels 170*a*, 172*a* which are separated by a tear strip 190, which is defined by severance lines 164*a*, 164*b* and will be described in further detail below.

The first extension panels 170*a*, 172*a* are hingedly connected to second extension panels 174*a*, 176*a* along fold lines 178*a*, 180*a*, respectively. Each of the fold lines 178*a*, 180*a* extends convergingly from fold line 142*a* to a cutout (which may also be considered a notch or a void) V that separates the second extension panels 174*a*, 176*a* and defines a distal end of the top end flap 132*a*. The second extension panels 174*a*, 176*a* are further hingedly connected to tabs 182*a*, 184*a* along fold lines 186*a*, 188*a*, respectively. It should be noted that the side end flaps 130*a*, 134*a* are separated from the tabs 182*a*, 184*a*, respectively, along cut lines C.

Certain of the end flaps are connected to adjacent end flaps by respective intervening gusset panels. The bottom end flap 136*a* is connected to the side end flaps 134*a*, 138*a* by gusset panels 171 *a*, 173*a*, respectively. The side end flaps 134*a*, 138*a* are hingedly connected to gusset panels 171*a*, 173*a* along a fold line 175*a*, 177*a*, respectively. The gusset panels 171*a*, 173*a* are further hingedly connected to the bottom end flap 136*a* along fold lines 154*a*, 156*a*, respectively.

The second extension panels 174*a*, 176*a* include distal edges E1, E2. The width of the cutout V is defined by the edges E3, E4 of the second extension panels 174*a*, 176*a*, respectively, and the cutout V is further defined by an edge E5 of the top end flap 132*a*.

The tear strip 190 extends across the top panel 112 to define side expansion panel portions 192, 194 of the top panel 112. The tear strip 190 further extends across the top end flaps 132*a*, 132*b* to define the first extension panels 170*a*, 172*a*. The opposing distal ends of the severance lines 164*a*, 164*b* extend to the cutouts V, terminating at the convex distal edges E5, respectively. The first extension panels 170*a*, 172*a* are hingedly connected to respective portions 192, 194 of the top panel 112 along fold line 142*a* so as to remain connected thereto after removal of the tear strip 190.

Erecting the carton 200 from the blank 100 may be accomplished with the folding operations as described herein. The operations can be performed entirely or in part by automatic erecting machinery or manually. The method of performing the erecting process is not limited to the exemplary method described. Particularly, the order of the steps can be altered according to manufacturing requirements, steps may be added or omitted, and the means for securing components to one another may vary. The surfaces of sheet material may be secured together by suitable means for securing, such suitable securing means including tape, staples, interlocking folds, VELCRO®, glue or other adhesives, combinations thereof, and the like.

A first phase of setup can be performed on what is typically referred to as Inplant Equipment (IPE). Specifically, the blank 100 can be folded and secured into a collapsed tubular structure that can thereafter be erected into a loadable condition without additional gluing. The loadable condition is achieved when an open-ended tubular structure T can be loaded through one or both ends and then sealed, as described in further detail below.

Figure 2:
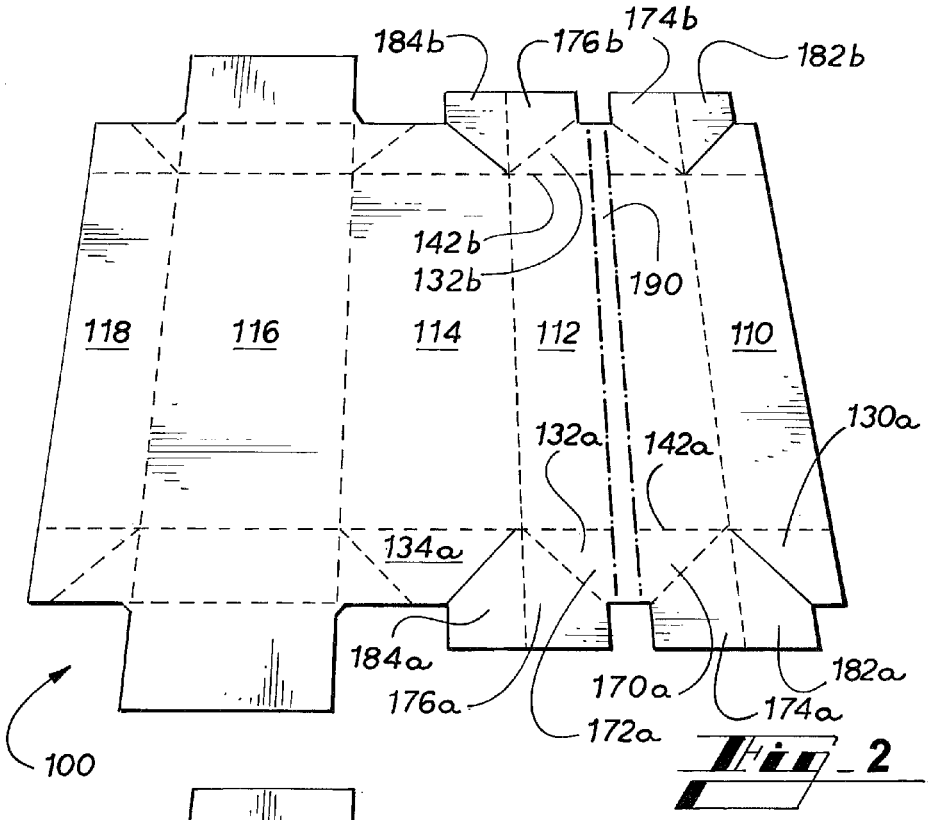
FIGS. 2-9 are perspective views of the blank of FIG. 1 showing the set up of a carton formed from the blank of FIG. 1.
Figure 3:
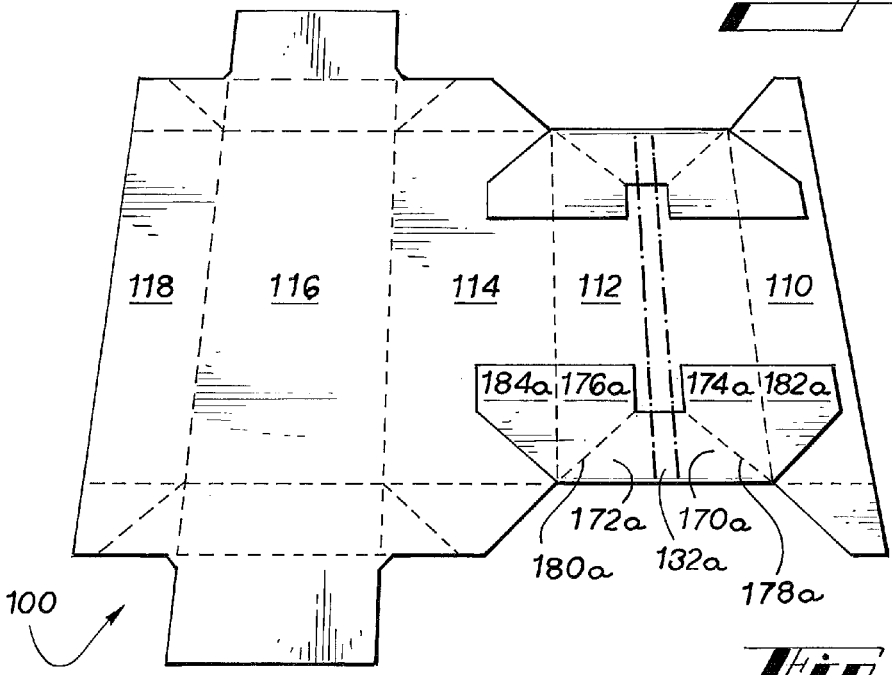

Referring to FIGS. 2 and 3, the inside surface of the blank 100 is folded along fold line 142*a* such that inside surfaces of the top end flaps 132*a*, the second extension panels 174*a*, 176*a*, and the tabs 182*a*, 184*a* are in a face-contacting arrangement with the inside surfaces of the first side panel 110, the top panel 112, and the second side panel 114, respectively.

Figure 4:
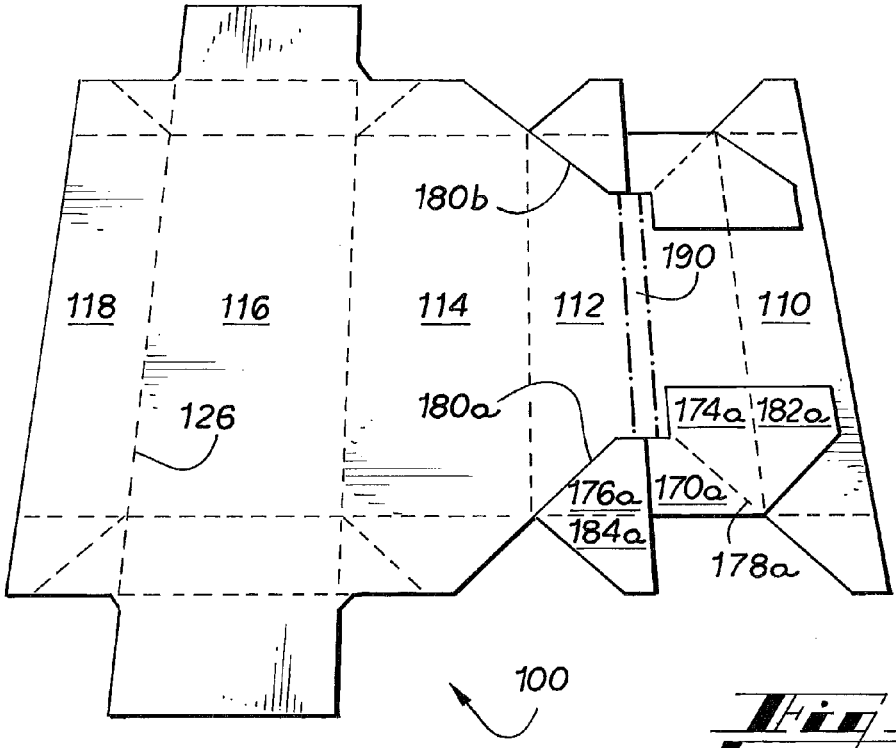
Figure 5:
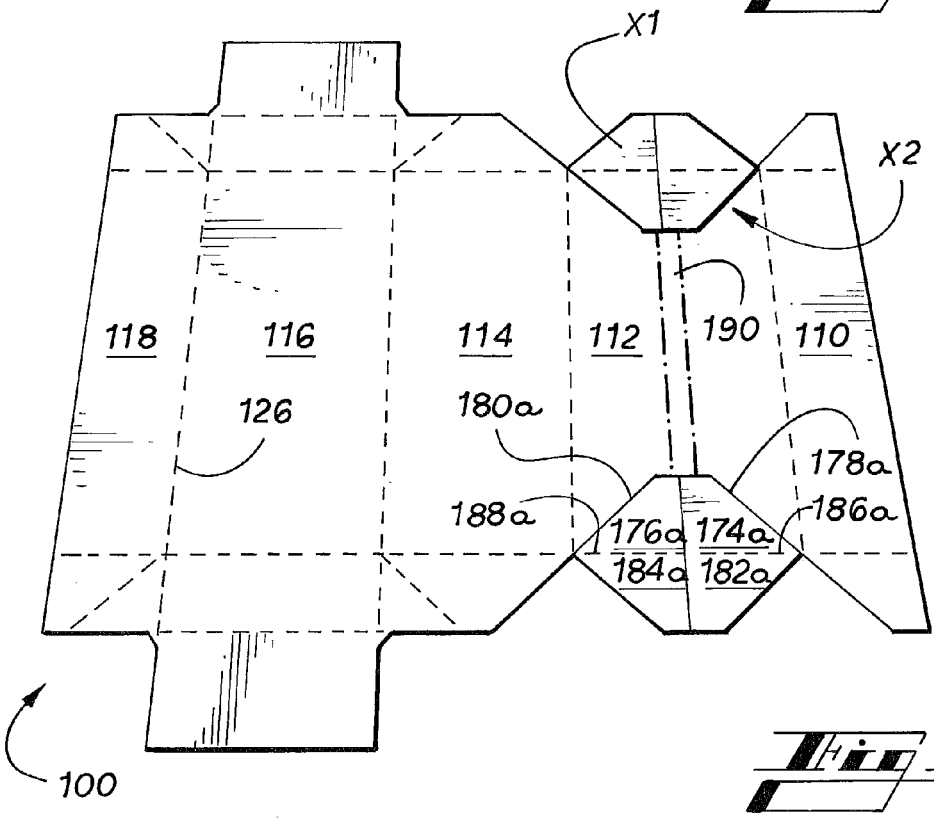

Referring to FIGS. 3-5, the blank 100 is folded along the fold lines 178*a*, 180*a* such that the outside surfaces of the second extension panels 174*a*, 176*a* are in a face-contacting arrangement with the outside surfaces of the top end flap 132*a* generally and its constituent elements first extension panels 170*a*, 172*a*, respectively. Thereby, the portions of the second extension panels 174*a*, 176*a* and the tabs 182*a*, 184*a* that are adjacent to the edges E1, E2 overlap one another and are secured to one another. Tabs 182*a*, 184*a* are secured to one another to form a composite top end flap X1 that at least partially forms an end closure structure of the carton, as described in further detail below. The second extension panels 174*a*, 176*a* are secured to one another and, along with the first extension panels 170*a*, 172*a*, define a two-ply expandable structure (also considered to be an expansion feature) X2. As the portions of the second extension panels 174*a*, 176*a* and the tabs 182*a*, 184*a* are secured to one another, the fold lines 186*a*, 188*a* substantially align to define a fold line 186*a*/188*a* along which the end flap X1 is hingably connected to the expansion feature X2. More specifically, the composite end flap X1 and the pair of second extension panels 174*a*, 176*a* are joined to one another along the fold line 186*a*/188*a*. Further, the end flap X1 and the pair of second extension panels 174*a*, 176*a* are at least initially coplanar with respect to one another across the line 186*a*/188*a*. The line 186*a*/188*a* does not serve as a fold line until the end flap X1 is folded downwardly to close the end of the tubular structure T. The fold line 186*a*/188*a* is aligned with or is otherwise substantially adjacent to fold line 142*a* along which the expansion feature X2 is hingedly connected to the top panel 112.

Figure 6:
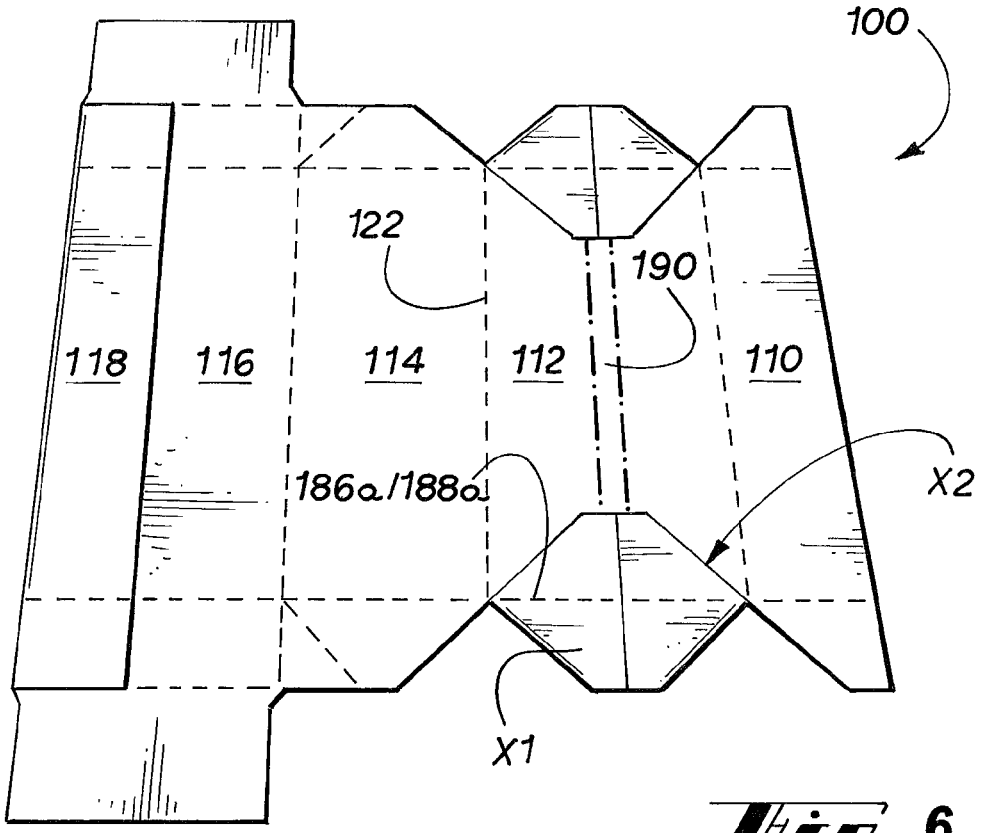
Figure 7:
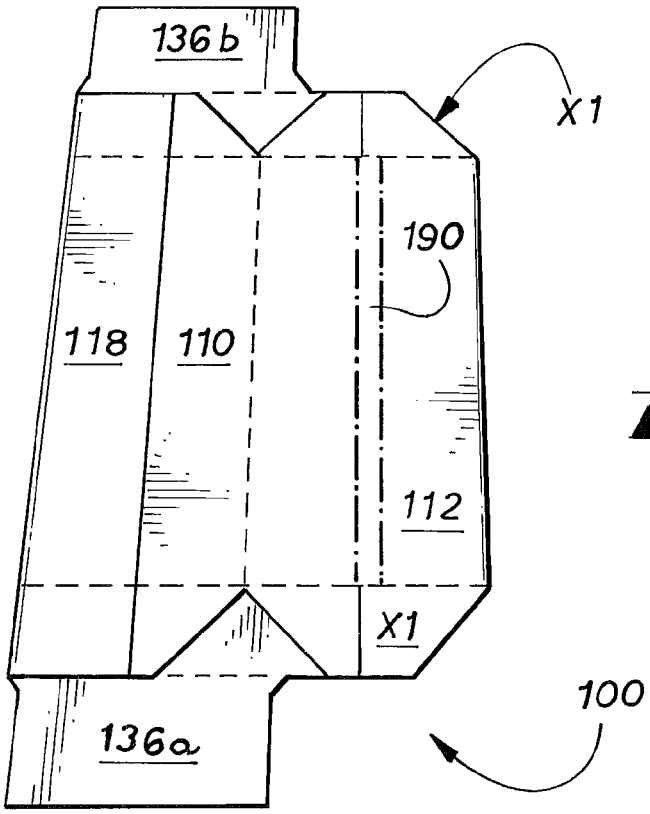

Referring to FIGS. 6 and 7, glue or other adhesive is applied to at least one of the inside surface of the first side panel 118 and the outside surface of the first side panel 110 so that the portion of the first side panel 118 adjacent to the edge 119 overlaps and is secured to the first side panel 110. Similarly, the first end flaps 130*a*, 138*a* overlap and are secured to one another. Referring to FIG. 7, the collapsed tubular structure T of the carton 200 is formed as the first side panels 110, 118 are secured to one another to form a composite first side panel 110/118 and the first side end flaps 130*a*, 138*a* are secured to one another to form a composite first side end flap 130*a*/138*a*.

The carton is now in a collapsed tubular condition which is ready for the second phase of setup, including automatic erecting, loading and sealing using outplant equipment (OPE). OPE, including the apparatus of the invention that is described in further detail below, is typically located in a bottling or packaging facility that is distinct from the location where the tubular structures T and the collapsed cartons 200 are formed. Those skilled in the art will be familiar with the equipment and methods for erecting, loading, and sealing a tubular carton. Therefore, only operations specific to the embodiments described herein will be detailed.

Figure 8:
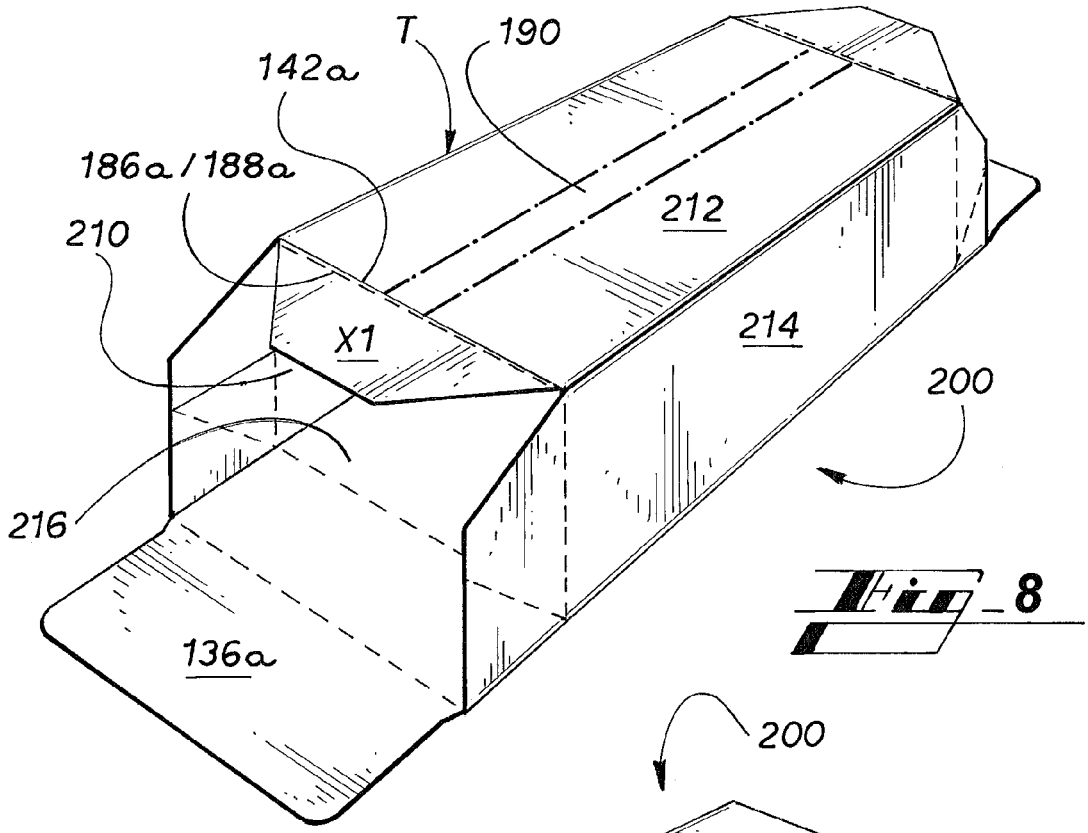

As shown in FIGS. 8 and 9, the cartons are erected as tubular structures T. The primary panels that define the tubular structure T and the end closure structures define the walls of the carton 200. The top panel 112 defines a top wall 212, the side panels 110/118, 114 define side walls 210, 214, and the bottom panel 116 defines a bottom wall 216. The side 130*a*/138*a*, 134*a* and bottom 136*a* end flaps can be arranged to align with a respective wall of the carton 200 or can otherwise be folded outwardly to facilitate loading. Accordingly, articles, such as cans, can be easily loaded into the carton 200.

Referring to FIG. 10, an end wall 218 which can be seen and an opposing end wall 22 that cannot be seen in this view are formed from the various flaps that are overlapped and adjoined to form end closures for the tubular structure.

Figure 11:
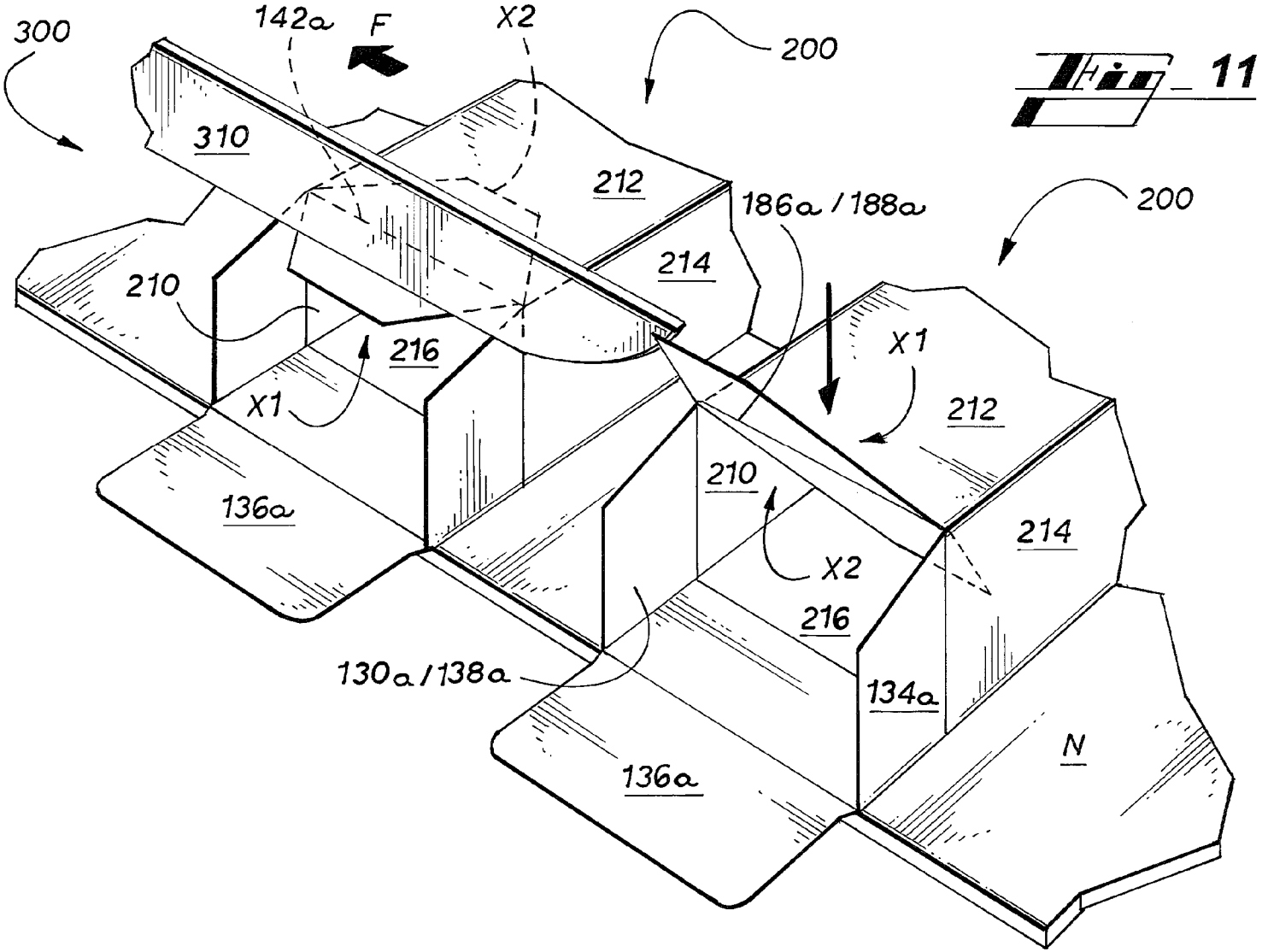
FIG. 11 is a perspective view of an exemplary embodiment of an apparatus for loading a carton.

Referring to FIG. 11, an apparatus 300 is illustrated that includes means for deflecting the end flap X1 according to the exemplary method. The apparatus 300, or a packaging machine of which the apparatus 300 is a part, includes a conveyor N on which tubular structures T are supported and transported in a flow direction F. In the exemplary embodiment, means for deflecting the end flap X1 includes a guide 310 that extends substantially parallel to the flow direction F. The guide 310 is dimensioned and positioned such that, as a carton 200 is transported by the carton conveyor N within contacting proximity of the guide 310, the angled upstream end of the guide 310 contacts the end flap X1 to pivot the expansion feature X2 about the fold line 142*a*. The end flap X1 continues to deflect or pivot until it comes in contact with the bottom edge of the guide 310, where the end flap X1 is held at a maximum deflected position until reaching the end of the guide 310. It should be understood that the end flap X1 is deflected or pivoted by a certain amount such that the extension feature X2 is deflected a certain amount and such that the end flap X1 and the extension feature X2 remain substantially coplanar. Thereafter, the articles can be loaded through the first open end of the tubular structure T. It should be understood that the guide 310 is disposed adjacent to the second open end of the tubular structure T.

Figure 12:
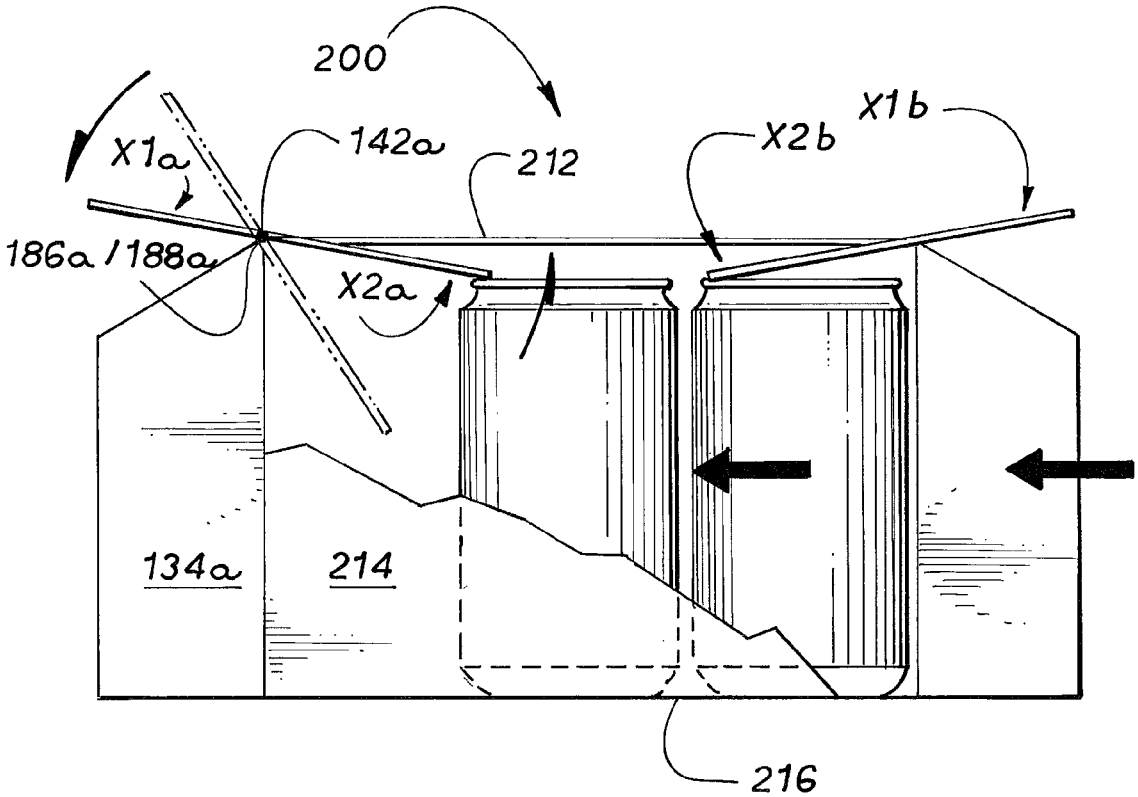
FIG. 12 is a side elevation view of a carton illustrating a step of an exemplary embodiment of a method of loading the carton.

Referring to FIG. 12, when the carton 200 is erected as a tubular structure T, the expansion features X2 in effect become inwardly-extending structures that tend to extend into the open ends of the tubular structure T or to otherwise obstruct the open ends of the tubular structure T. The end flaps X1 extend outwardly from the open ends of the tubular structure T. To aid in this portion of the description, the end flaps X1 and expansion features X2 will be denoted by the alphabetical suffixes "a" and "b" that have been previously used herein to distinguish features at opposing ends of the carton 200. As articles are loaded through a first open end of the tubular structure T, the articles contact a first expansion feature X2*b* and displace the first expansion feature X2*b* toward the top wall 212 so as to properly position the first expansion feature X2*b*. As the articles continue to move through the tubular structure T toward a second open end of the tubular structure T, the articles would tend to contact a second expansion feature X2*a* that is hinged at the opposing end of the carton tubular structure T. If this contact were to occur the articles might displace the second expansion feature X2*a* towards the open end so as to improperly position the second expansion feature X2*a* or the articles might be made to tip over.

The exemplary method and apparatus will facilitate loading the carton 200 such that the second expansion feature X2*a* is properly positioned and does not cause the articles to tip over. Specifically, the exemplary methods and apparatuses position the second expansion feature X2*a* such that the second expansion feature X2*a* is stowed along the inside surface of the top wall 212. To displace the second expansion feature X2*a* from the second or non-loading end of the tubular structure T, the corresponding end flap X1*a* is contacted, deflected, or pivoted such that the second expansion feature X2*a* deflects or pivots toward the inside surface of the top wall 212 of the tubular structure T. For example, the end flap X1*a* can be pressed downwardly so as to press the second expansion feature X2*a* or the distal end of the second expansion feature X2*a* against the inside surface of the top wall 212. As those skilled in the art will recognize, at minimum, the deflection of the end flap will at least cause the distal end of the second expansion feature X2*a* to be raised above the height of the articles such that the articles can slide underneath the second expansion feature X2*a*. In certain embodiments, the distal end is flush with the top wall, while in certain embodiments, the entire expansion feature X2*a* is flush with the top wall.

In alternative embodiments, means for deflecting can include guide structures that travel along a path in the flow direction F and extend downwardly or otherwise transversely with respect to the flow direction F to contact the end flaps X1 or the top walls of the cartons 200. For example, means for deflecting can include a plunger apparatus with plungers that extend to deflect the end flaps X1. As another example, the plungers can have a substantially flat shape and extend into the open end of the carton to hold the expansion features against the inside surface of the top wall 212. Thereby, the articles can slide underneath the plunger as they are loaded and the plunger is thereafter removed before forming the end closure.

In certain embodiments, the apparatus 300 may also include means for deforming the end flap X1 to prevent the end flap X1 and the expansion feature X2 from folding along the fold line 186*a*/188*a*. In certain embodiments, means for deforming includes the guide 310 wherein the guide 310 is disposed to engage the end flap X1 in such a manner that it deforms sufficiently to inhibit the end flap X1 and the expansion feature X2 from folding along the fold line 186*a*/188*a*. In alternative embodiments, means for deforming includes the plunger apparatus described above. For example, the plunger apparatus can include plunger elements with pointed ends that contact a central portion of the end flap X1 and/or a central portion of the top wall 212 such that the end flap X1 and expansion feature X2 bow, thereby making it difficult to fold the end flap X1 and expansion feature X2 along the fold line 186*a*/188*a*. In other embodiments, the material properties of the carton 200 are such that the end flap and expansion feature X2 do not fold along the fold line 186*a*/188*a* as the end flap X1 is contacted or deflected and means for deforming is omitted.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging system comprising:

translating a substantially tubular end-loadable carton comprising a top wall, an inwardly-extending structure foldably adjoining said top wall stowable in a substantially flat-face position with an underside of said top wall, and a top end flap connected to said inwardly-extending structure;

disposing a flap deflector to engage and downwardly deflect said top end flap and thereby pivot said inwardly-extending structure into said substantially flat-face position with said underside of said top wall as said end-loadable carton is translated; and loading said end-loadable carton with articles, and wherein said inwardly-extending structure is prevented from impeding the loading of articles into said carton.

2. The packaging system of claim 1, wherein said substantially tubular end-loadable carton is linearly translated.

3. The packaging system of claim 2, wherein said substantially tubular end-loadable carton is linearly translated by a conveyor.

4. The packaging system of claim 1, wherein at least a portion of said inwardly-extending structure and said top end flap are at least initially substantially coplanar.

5. The packaging system of claim 1, wherein said inwardly-extending structure and said top end flap are foldable with respect to one another.

6. The packaging system of claim 1, wherein said inwardly-extending structure and said top end flap are foldable with respect to one another about a first line that is adjacent and substantially parallel to a second line about which said inwardly-extending structure and said top end flap are pivotable with respect to said top wall.

7. The packaging system of claim 1, wherein said flap deflector comprises a guide.

8. The packaging system of claim 7, wherein said guide is adapted for deforming said end flap as it is engaged so as to inhibit folding of said inwardly-extending structure with respect to said end flap.

9. An apparatus for facilitating loading of an end-loadable carton, the carton having a top wall and a hinged structure hingedly connected to the top wall, the hinged structure including a top end flap for at least partially closing an end of the carton and an inwardly-extending structure connected to the top end flap along a fold line, the inwardly-extending structure extending inwardly from the top end flap and stowable adjacent to an inside surface of the top wall, the apparatus comprising:

means for downwardly deflecting the top end flap so as to press the inwardly-extending structure against the inside surface of the top wall to prevent the inwardly-extending structure from impeding passage of articles as the carton is loaded with the articles.

10. The apparatus of claim 9, wherein:

the apparatus is for use in a packaging machine having a carton conveyor for conveying the carton; and said means for deflecting comprises a guide that contacts the top end flap as the carton is driven past said guide on the carton conveyor.

11. The apparatus of claim 10, wherein said guide is adapted for deforming the carton so as to inhibit folding at the fold line connection between said inwardly-extending structure and said top end flap.

* * * * *